United States Patent [19]

Condon

[11] Patent Number: 4,524,910

[45] Date of Patent: Jun. 25, 1985

[54] HEATER USING HOT WASTE FLUE GASES

[76] Inventor: Larry J. Condon, 307 E. End Ave., Pittsburgh, Pa. 15221

[21] Appl. No.: 417,050

[22] Filed: Sep. 13, 1982

Related U.S. Application Data

[62] Division of Ser. No. 199,580, Oct. 22, 1980, Pat. No. 4,363,442.

[51] Int. Cl.[3] ..... F24B 7/00

[52] U.S. Cl. ..... 237/81; 165/DIG. 2; 237/55

[58] Field of Search ..... 237/50, 51, 55, 81; 236/10, 49; 126/101, 110 R, 121, 307 R, 312; 165/DIG. 2, DIG. 12, 76, 78, 79

[56] References Cited

U.S. PATENT DOCUMENTS

| | | | |
|---|---|---|---|
| 143,739 | 10/1873 | White | 237/55 |
| 2,029,450 | 2/1936 | Truelsen | 237/55 |
| 4,308,990 | 1/1982 | Borovina et al. | 237/55 |

FOREIGN PATENT DOCUMENTS

| | | | |
|---|---|---|---|
| 207295 | 11/1923 | United Kingdom | 237/55 |

*Primary Examiner*—Henry Bennett

*Attorney, Agent, or Firm*—Thomas H. Murray; Clifford A. Poff

[57] ABSTRACT

A method and apparatus to heat a forced-air supply utilizing hot waste gases in a flue. A flue closure housing is supported by a frame that is arranged to surround an opening in the chimney. The housing supports a heat exchanger having side walls formed of plates with a space between the plates being sealed by end walls to form a flow space for a forced-air supply. The heat exchanger is sealed to a flue closure plate forming part of the flue closure housing. The heat exchanger receives a supply of cold air from a motor-driven blower coupled to a header. Heated air from the heat exchanger is directed by a hot-air discharge header through an opening in the flue closure housing.

5 Claims, 4 Drawing Figures

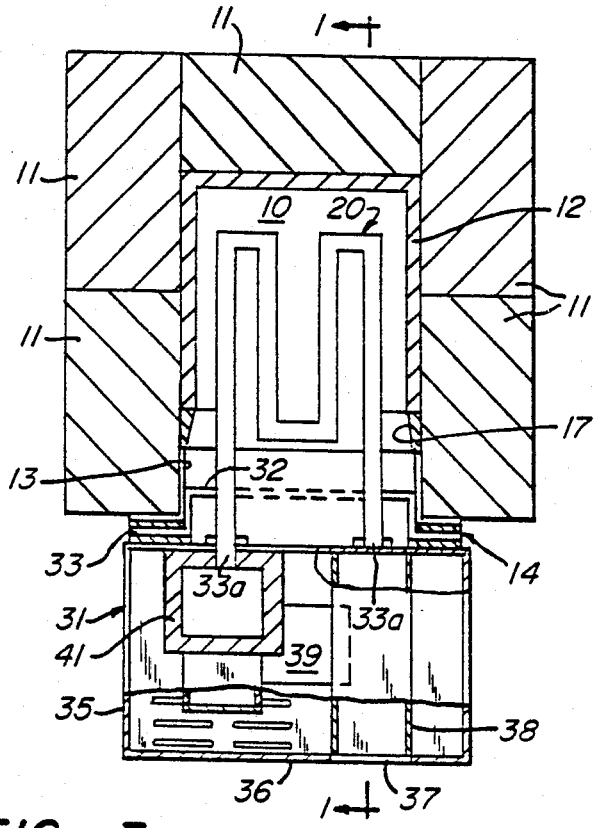
FIG. 2
FIG. 3
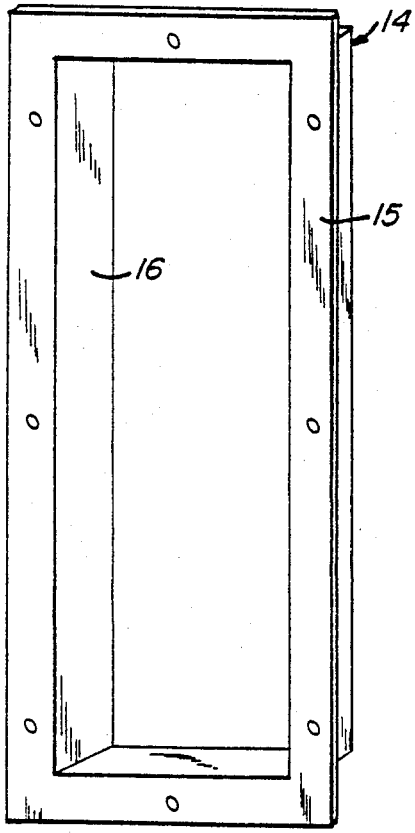
FIG. 4
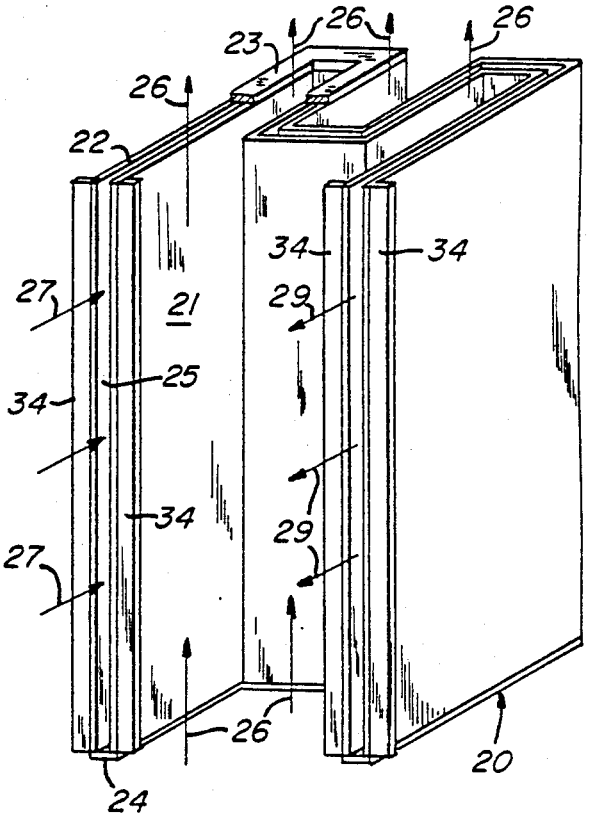

HEATER USING HOT WASTE FLUE GASES

This is a division of application Ser. No. 199,580, filed Oct. 22, 1980 now U.S. Pat. No. 4,363,442 issued 12-14-82.

BACKGROUND OF THE INVENTION

This invention relates to a method and apparatus to heat a forced-air supply with sensible heat recovered from a hot stream of waste flue gases while passing along a chimney of a dwelling or the like by forming an opening in the wall of the chimney to install and operatively support a heat exchanger.

The efficiency of heating systems can be increased by a greater utilization of heat produced by burning fuel within the dwelling. In dwellings, particularly family dwellings, flue gases are generated from one or more sources. It is common practice to heat a family dwelling by a forced-air-heating system including a furnace wherein fuel such as oil, liquid gas or natural gas is burned within a chamber that is coupled to a flue provided by a chimney for discharging hot waste gases of combustion into the atmosphere. Water heaters using heat from the combustion of fuel also discharge waste gases into the flue provided by the chimney. It is also common practice, with increasing popularity, to burn fuel in a fireplace and thereby provide heat for one or more rooms of a dwelling. This hot waste gas is carried from the dwelling by the flue of a chimney. The sensible heat of the gases which is exhausted by the chimney to the atmosphere represents a substantial loss to the heating efficiency and the required use of fuel and ever-increasing costs.

The present invention seeks to recover sensible heat from waste fuel gases while conducted by a flue in a manner that is not detrimental to the operation of the flue. The method and apparatus is particularly designed for use with existing flues by embodying a construction of parts that, while a part thereof extending into the flue-conducting space of the chimney, the cross-sectional area of the chimney is not reduced.

SUMMARY OF THE INVENTION

It is an object of the present invention to provide an apparatus embodying a construction of parts for safe attachment to a flue so that a heat exchanger part extends from an opening provided in the flue wall for projecting into a stream of flue gas to heat a forced-air supply and recover sensible heat.

It is a further object of the present invention to provide an apparatus designed for attachment in a sealed manner to a special opening formed in the wall of a chimney for withdrawing heat from hot flue gases delivered by the chimney without creating an obstruction or impairing the chimney operation.

More particularly, according to the present invention there is provided an apparatus to heat a forced-air supply with hot waste gases while conducted by a flue having a side wall with an opening for access to a stream of flue gases, the combination including a frame supported by the side wall of the flue to surround the opening therein, a flue closure housing supported by the frame to form a gas-tight enclosure for the opening in the side wall flue, a heat exchanger having walls forming an internal passageway to conduct air along a path transverse to the stream of flue gases in the flue, the heat exchanger being supported by the flue closure housing, a cold-air supply header supported by the flue closure housing while coupled to communicate with the internal passageway of the heat exchanger, a hot-air discharge header supported by the flue closure housing while coupled to communicate with the internal passageway of the heat exchanger, and blower means to force air through the heat exchanger.

In the preferred form, the apparatus includes a thermocouple supported by the flue closure housing to extend into the stream of flue gas at a point preferably located above the heat exchanger. A controller is coupled for response to a signal from the thermocouple to control the operation of the blower means so that air is forced through the heat exchanger when the temperature of the flue gases rises above the predetermined minimum temperature and to insure that the flue gases passed from the heat exchanger retain a sufficient quantity of heat for safe operation of the chimney. The internal passageway of the heat exchanger is defined by walls that are planar in the flow direction of the stream of the flue gases. The internal passageway formed in the heat exchanger preferably includes a plurality of reverse bends transverse to the stream of flue gases. The passageway in the heat exchanger is preferably an elongated slot parallel to the stream of flue gases and enclosed at its opposite ends by walls joined to the planar side walls for maintaining a spaced relation thereof.

The method of the present invention for heating a forced-air supply with sensible heat recovered from a hot stream of waste flue gases in a chimney or the like for supplying heat to a dwelling includes the steps of forming an access opening through a side wall of the chimney to the flow space therein for hot waste gases, securing a frame in a substantially airtight manner to the wall of the chimney to surround the access opening therein, using the access opening to arrange planar walls of a heat exchanger generally parallel to and within the flow space for hot waste gases in the chimney, supporting the heat exchanger by a housing attached to the frame to close the access opening in the frame in a substantially airtight manner, feeding air from the housing into an enclosed heat exchange space between the planar wall of the heat exchanger for heating therein, and directing a heated discharge flow of air from the heat exchanger through the housing into the dwelling.

These features and advantages of the present invention as well as others will be more fully understood when the following description of the preferred embodiment is read in light of the accompanying drawings, in which:

FIG. 2 is a sectional view taken along line II—II of FIG. 1;

FIG. 3 is an isometric view of a frame to surround an opening formed in a chimney to support the remaining apparatus of the present invention; and FIG. 4 is an isometric view of a heat exchanger forming part of the apparatus of the present invention.

Figure 1:
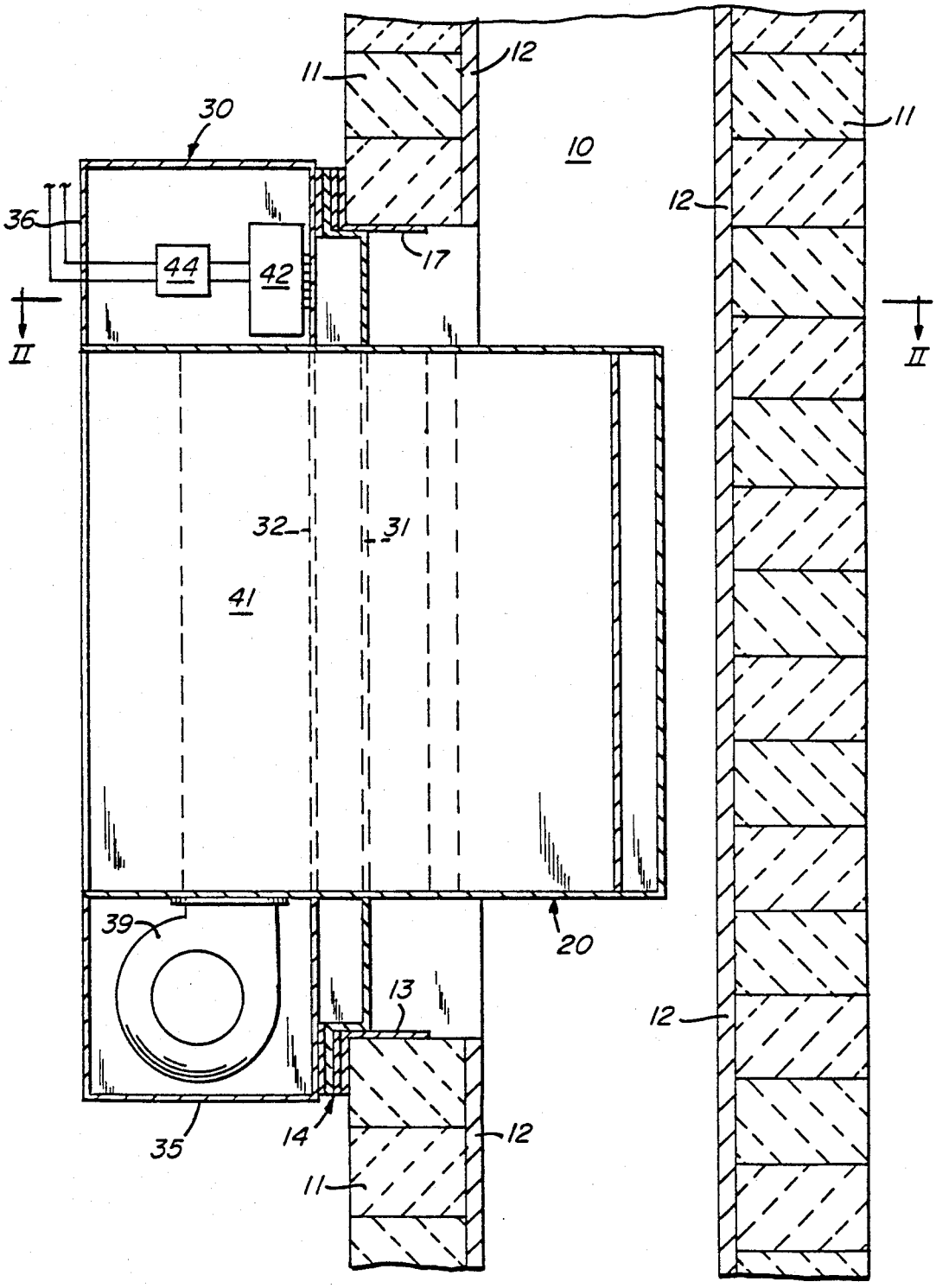
FIG. 1 is an elevational view, in section, taken along line I—I of FIG. 2, of the apparatus operatively supported to extend into the flue space of a chimney according to the method of the present invention.

In FIG. 1, reference numeral 10 identifies the flue space provided in a chimney which embodies a construction that is per se well known in the art. For purpose of disclosing the apparatus of the present invention, the chimney includes courses of brick 11 that form an internal opening that is dimensioned to receive tubular liners 12. The liners 12 are typically comprised of tile pipe each with a preselected length and arranged one on top of the other to form a continuous flow space in the chimney for hot waste gases. An access opening 13 is formed in the wall of the chimney by the removal of selected bricks so that a rectangularly-shaped opening is provided thereby. A hole is then formed in one or more lengths of liner pipe 12 for direct access to the flue space from the interior of the dwelling. In FIG. 1, a hole is formed in one side wall of each of two abutting liner pipes 12 so as to form an extension to opening 13. A rectangularly-shaped frame 14, which is best shown in FIG. 3, is then moved into the opening after a suitable spreadable sealant has been applied to the brick-contacting surfaces of the frame. The frame includes a front flange 15 joined with a liner wall 16 projecting at right angles from the front flange. Thus, the frame 14 embodies an L-shaped configuration in cross section. A series of holes spaced about the front flange 15 are used to pass a threaded fastener into drilled holes in the brickwork surrounding the opening 13. The inner space openings between the brickwork and the frame are sealed through the use of any one of a number of well-known sealants. As best shown in FIG. 2, a body of sealant is used between the cut surface of the liners 12 forming extensions to opening 13 and the projecting end surface of the frame when installed in the opening. Such a body of sealant material is identified in FIG. 2 by reference numeral 17.

The apparatus of the present invention further includes a heat exchanger 20, the preferred form of which is shown in FIG. 4. The heat exchanger includes two spaced-apart metal plates 21 and 22 that are joined together in spaced-apart relation at opposite edges by end plates 23 and 24. The spaced relation of the plates forms an internal passageway in the form of an elongated slot 25. The plates 21 and 22 are bent so that the flow space forms at least one reverse bend, preferably a plurality of reverse bends, three of which are embodied in the configuration of the heat exchanger shown in FIG. 4. Hot waste flue gases pass along in a direction indicated by arrows 26 which is transverse to the flow direction of a forced-air supply that is directed to the flow space as indicated by arrows 27. As the forced-air supply passes along the slot between the plates 21 and 22, the air undergoes heating by the transfer of heat through the plates from the stream of flue gases. The heated stream of air is discharged from the passageway as indicated by arrows 29. Thus, it can be seen that the passageway is elongated in a direction which is parallel to the stream of flue gases formed by the metal plates 21 and 22 that are planar with respect to the flow direction by the stream of flue gases.

The heat exchanger is attached in a sealed manner to a flue closure housing 30 shown in FIGS. 1 and 2. The flue closure housing 30 is joined to a flue closure plate 31 that is attached by threaded fasteners to the frame 14 after gaskets 32 have been placed therebetween. A back wall plate 33 of housing 30 has two elongated slots 33A arranged in a spaced-apart relation to communicate with the entry and delivery of flow spaces in the heat exchanger. The plates 21 and 22 of the heat exchanger are attached in a sealed manner to the flue closure plate such as by continuous beads of weld or by means of mounting flanges 34 that can be attached by means of welding or threaded fasteners. When fasteners are used, a gasket 32 is interposed between the flanges 34 and back wall plate 33. The flue closure housing 30 further includes side walls projecting outwardly from the exposed face surface of the chimney to support a front wall 36. Wall 36 has an air-discharge opening 37 communicating with one end of a hot-air discharge header 38. The other end of discharge header 38 is attached to the back wall plate 33 to surround the slot 33A therein used to deliver heated air from the heat exchanger. The slotted holes in the side wall of the housing 30 feed a supply of cold air from the dwelling to a motor-driven blower 39. The blower is connected to a header 41 that is, in turn, attached to the flue closure plate to enclose the remaining opening 33A so that the forced-air supply from the blower is delivered to the internal passageway of the heat exchanger. As shown in FIG. 1, a thermocouple assembly 42 is supported by the plate 33 within the flue closure housing so that the temperature-sensitive element extends into the flow space in the chimney at a location which is spaced about the heat exchanger. The thermocouple assembly 42, while of the type well known in the art, includes control adjustments by which minimum and maximum temperatures can be set for operation of a controller 44 used to control the operation of the motor-driven blower. In this way, the blower can be turned ON only when a minimum temperature in the flue is sufficient to recover sensible heat from the flue gases and, at the same time, prevent the withdrawal of such quantities of heat from the flue gases so as to impede the operation of the chimney. Moreover, when the temperature of the flue gases falls below a preset lower temperature limit, the thermocouple assembly responds to turn OFF the supply of current to the motor-driven blower.

As described hereinbefore, the apparatus of the present invention embodies a design of parts to avoid the forming of a restriction in the chimney. In this regard, the cross-sectional area in the chimney is maintained essentially the same since an area for the flow of flue gases in the chimney is increased by the removal of brick from the chimney wall to support the apparatus of the present invention. This increase to the area of the chimney is offset by the cross-sectional area occupied by the heat exchanger such that there is approximately no net change to the flow space for flue gases in the chimney while passing beyond the heat exchanger.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A method for heating a forced-air supply with sensible heat recovered from a hot stream of waste flue gases in a chimney or the like for supplying heat to a dwelling, the method including the steps of forming an access opening through a side wall of said chimney to the flow space therein for hot waste gases, securing a frame in a substantially airtight manner to the wall of said chimney to surround the access opening therein, selecting a heat exchanger to occupy a cross-sectional area of the chimney which substantially corresponds to the cross-sectional area of the access opening formed in the side wall of said chimney, using the access opening to arrange planar walls of a heat exchanger generally parallel to and within the flow space for hot waste gases in the chimney, supporting said heat exchanger by a housing attached to said frame to close the access opening in the frame in a substantially airtight manner, using the access opening along the inside of the housing facing the chimney for the flow of hot waste gases, feeding air from the housing into an enclosed heat exchange space between the planar wall of said heat exchanger for heating therein, and directing a heated discharge flow of air from the heat exchanger through the housing into the dwelling.

2. The method according to claim 1 wherein said forming an access opening includes exposing an outer surface of a chimney liner by the removal of brick forming part of said chimney, and cutting said chimney liner for access to the flow space therein for hot waste gases.

3. The method according to claim 1 wherein said step of feeding air includes supporting a motor-driven blower in said housing to direct a stream of air into said heat exchange space of the heat exchanger.

4. The method according to claim 3 further including controlling said motor-driven blower in response to a predetermined temperature of hot waste gases in the chimney.

5. The method according to claim 1 wherein said using the access opening includes arranging said planar wall of a heat exchanger to define a plurality of reverse bends.

* * * * *